US006205836B1

(12) United States Patent
Yamagata et al.

(10) Patent No.: US 6,205,836 B1
(45) Date of Patent: Mar. 27, 2001

(54) METHOD FOR MANUFACTURING PISTON BY FORGING AND FORGING DIE

(75) Inventors: Hiroshi Yamagata; Toshikatsu Koike, both of Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/350,563

(22) Filed: Jul. 9, 1999

(30) Foreign Application Priority Data

Jul. 9, 1998 (JP) ..... 10-193989

(51) Int. Cl.[7] ..... B21J 13/02
(52) U.S. Cl. ..... 72/359; 72/478
(58) Field of Search ..... 72/352, 358, 359, 72/377, 478, 463, 474

(56) References Cited

U.S. PATENT DOCUMENTS

| | | | | |
|---|---|---|---|---|
| 2,080,399 | * | 5/1937 | Beibel | 72/478 |
| 2,305,803 | * | 12/1942 | Bayer | 72/478 |
| 2,707,136 | | 4/1955 | Fahlman . | |
| 4,434,014 | | 2/1984 | Smith . | |

FOREIGN PATENT DOCUMENTS

| | | | | |
|---|---|---|---|---|
| 449 719 | | 1/1971 | (CH) . | |
| 3719121 A1 | | 12/1988 | (DE) . | |
| 3822031 A1 | | 1/1990 | (DE) . | |
| 0153 473 A2 | | 12/1984 | (EP) . | |
| 1226350 | | 7/1990 | (FR) . | |
| 57-9552 | * | 1/1982 | (JP) | 72/352 |
| 63-126661 | | 5/1988 | (JP) . | |
| 63-132743 | | 6/1988 | (JP) . | |
| 1-180927 | | 7/1989 | (JP) . | |
| 2-107749 | | 8/1990 | (JP) . | |
| 2-233858 | | 9/1990 | (JP) . | |
| 9-76042 | | 3/1997 | (JP) . | |

* cited by examiner

*Primary Examiner*—Lowell A. Larson
(74) *Attorney, Agent, or Firm*—Knobbe, Martens, Olson & Bear LLP

(57) ABSTRACT

An improved method of forging a piston and a forging die therefor. The forging die is formed from a pair of pieces which form an area where the forged material is extruded into. These pieces merge at a parting line that passes through the center of the outer edge of the forged material so as to afford some relative movement between the die pieces to avoid cracking and also to permit air to escape. Some small flash or parting line may be present in the finished material which is not objectionable and permits the attainment of the higher strength and better wear resistant piston.

20 Claims, 5 Drawing Sheets

METHOD FOR MANUFACTURING PISTON BY FORGING AND FORGING DIE

BACKGROUND OF THE INVENTION

This invention relates to a method of manufacturing and a die therefor by which components such as pistons may be forged.

In the interest of reducing weight and improving performance, internal combustion engines normally utilize pistons formed from aluminum or aluminum alloy. Conventionally, these pistons are formed by a casting process. However, when utilizing casting, the full advantages of the aluminum material are not realized. Also, because of the casting process it is generally necessary to make the piston somewhat larger and heavier in order to provide adequate strength, wear resistance and durability.

The full advantages of the aluminum material can be utilized better if the pistons are made by a forging process. However, in connection with the forging of pistons, certain problems may arise.

That is, it is desirable to provide the piston with a dense and relatively uniform structure. However, due to the shape of the piston, this is difficult with conventional forging die, particularly if the forging is done in a single step. That is, the lower portion of the piston, specifically, the lower edges of the skirt and the ribs that connect the skirt to the piston pin bosses require rather extensive extrusion of the material in the forging die.

The area where these parts of the piston are extruded into generally is narrow and there is a problem that cracking of the die in this area may result. In addition, because of the amount of extrusion necessary to form these components of the piston, there is also some possibility of porosity being encountered at the lower extremities of these components.

These problems may be best understood by reference to FIGS. 1–3, which show a forged piston of a configuration of the type with which the invention has particular utility and FIGS. 4 and 5 which are cross-sectional views taken through a conventional forging die arrangement showing the blank in place in FIG. 4 and the finished forging step in FIG. 5.

As seen in FIGS. 1–3, a conventional forged piston is indicated generally by the reference numeral 21. This forged piston 21 is formed from aluminum alloy and specific materials which may be advantageously used may be described later in the specification. The piston is comprised of a head portion, indicated generally by the reference numeral 22 and which is comprised primarily of an upper surface 23 which cooperates with a recess formed in the cylinder head and the cylinder bore to form the combustion chambers of the engine.

Below this head surface 23, the head portion 22 is formed with one or more ring grooves 24 in which piston rings are provided for effecting sealing with the associated cylinder bore, These are normally formed by machining the forged blank at the completion of the forging process.

Depending from the head portion 22 on opposite sides thereof are a pair of generally spaced apart skirt portions 25. These skirt portions 25 are disposed on opposite sides of boss portions 26 in which piston pin receiving openings 27 are formed. Again, the pin receiving openings are machined at the completion of the forging operation. The boss portions 26 are interconnected to the skirt portions 25 by ribs 28.

Thus, it will be seen that the lower portions of the skirt portions 25 and the ribs 28 must undergo significant extrusion in the forging process in order to form the piston. This may be understood by reference to FIGS. 4 and 5 which show the forging apparatus by which the piston 21 is formed.

As seen in these figures, there is a female die indicated generally by the reference numeral 29 and which is comprised primarily of two parts consisting of a lower end closure 31 and a cylindrical body member 32. The end closure 31 has projecting portions that extend upwardly into a cylindrical cavity 33 formed by the cylindrical portion 32. This cavity is comprised of a pair of side parts 34 which have a deep extent and in which the skirt portions 25 are formed. In addition, there are a pair of circumferentially spaced recessed parts 35 that form the rib portions 28. These also require substantial extrusion of the material.

A forging male die 36 completes the die assembly and cooperates with the cavities 33, 34, and 35 to form the piston 21.

As may be seen, a blank 37 of the piston material is inserted into the cavity 33 at the upper portion thereof. The pressing die 36 then moves downwardly so as to force the blank into the cavity and downwardly into the portions 34 and 35 so as to form the finished blank, indicated by the reference numeral 38.

As may be seen, the deep extrusion of the skirt portion 25 and to some extent the rib portions 28 causes two significant problems. First, the clearance in the die is very small in these areas and hence there is a large expansion force that tends to cause cracking the die. In addition, air pockets may form in the lower part of these areas and cause porosity or irregularities in the lower shapes of the skirts 25 and ribs 28.

It is, therefore, a principal object of this invention to provide an improved forging die and method of forging a piston that will avoid these problems.

It is a further object of this invention to provide a forging die that permits the formation of the skirt and rib portions of the piston without the likelihood of cracking of the die and without causing porosity to exist in these portions of the finished piston.

SUMMARY OF THE INVENTION

A first feature of the invention is adapted to be embodied in a forging die that is comprised of a female die portion defining an internal cavity into which a blank is inserted and extruded through cooperation of a forging die male portion that extends into the cavity and cooperates with the female die so as to extrude a blank into a desired finished shape. This shape conforms generally to the cavity formed by the male and female die portions at the ends of their stroke. This cavity has a deep extrusion portion that defines a relatively narrow lower peripheral edge. One of the die portions is formed from two pieces that have mating edges that extend along the peripheral surface of this cavity extrusion portion and which can move relative to each other slightly so under compressive forces so as to provide stress relief and a path for air escape during the forging process.

Another feature of the invention is adapted to be embodied in a forging process utilizing, a die as set forth in the preceding paragraph. During the forging process, the male and female portions are moved relative to each other with a blank being interposed therebetween to extrude it into the shape formed by the finished cavity. A flash or parting line can be formed in the finished product at the area where the two die pieces meet.

DETAILED DESCRIPTION OF THE PREFERRED EMBODIMENTS OF THE INVENTION

Figure 1:
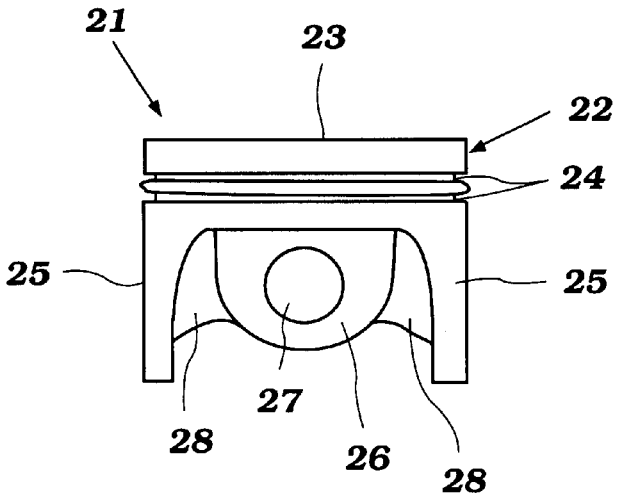
FIG. 1 is a side elevational view of a forged piston in its finished configuration.
Figure 2:
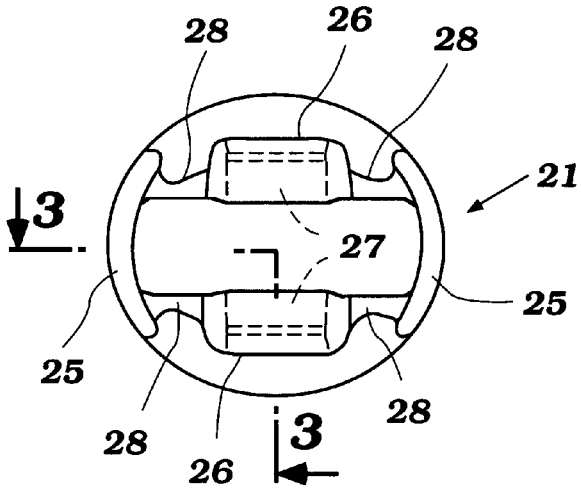
FIG. 2 is a bottom plan view of the piston.
Figure 3:
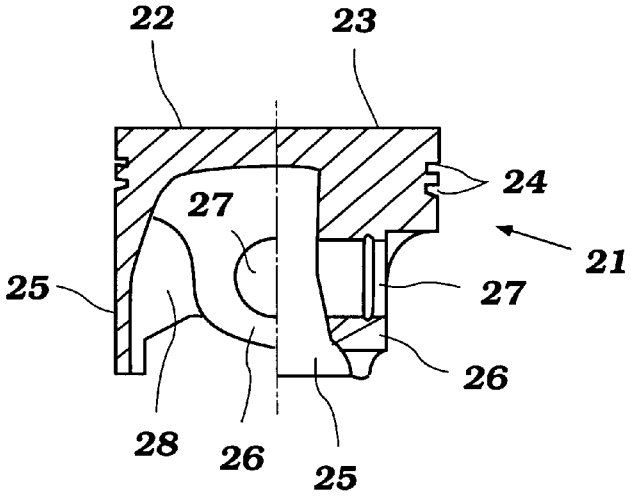
FIG. 3 is a cross-sectional view of the piston taken along the line 3—3 of FIG. 2.
Figure 4:
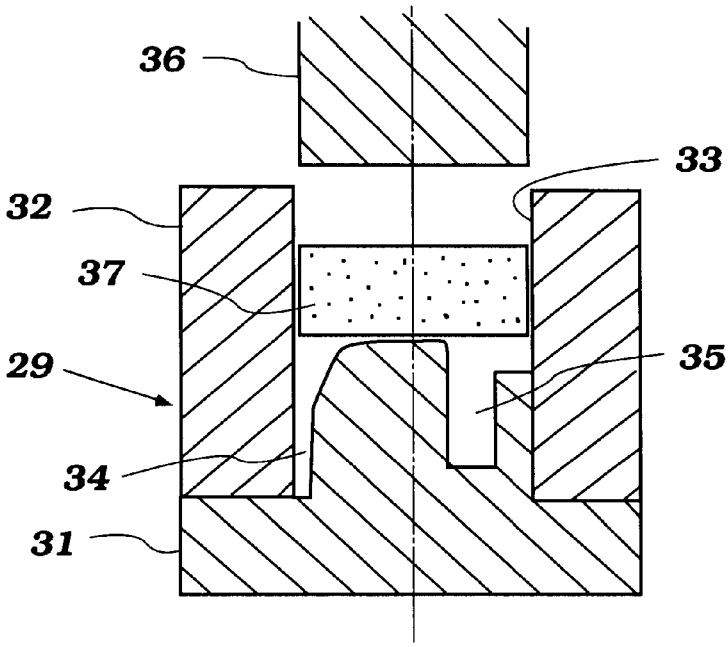
Figure 4 Prior Art
FIG. 4 is a cross-sectional view taken through a prior art type of forging die along a plane similar to the plane of FIG. 3 before the forging has occurred but with a blank in place in the cavity formed by the die.
Figure 5:
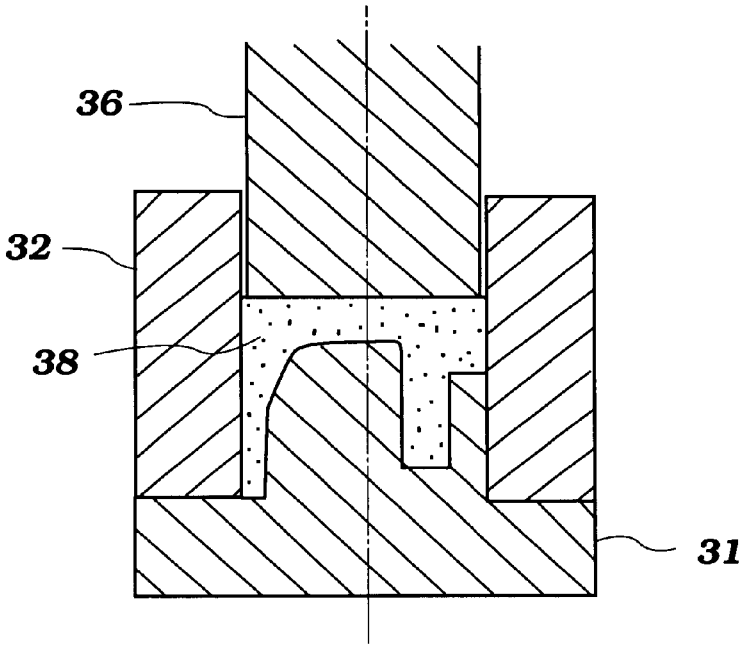
Figure 5 Prior Art
FIG. 5 is a cross-sectional view, in part similar to FIG. 4, but shows the end of the forging step.
Figure 6:
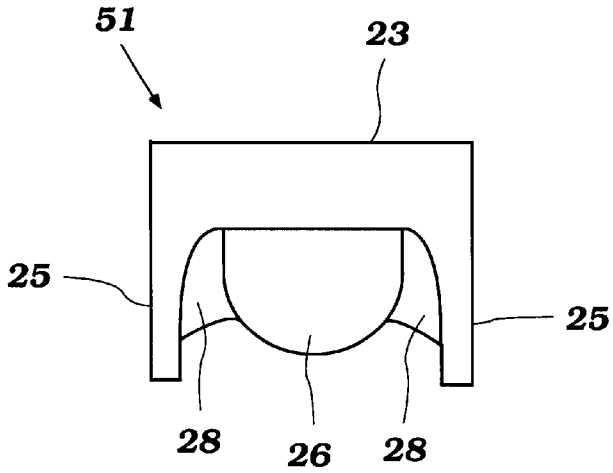
FIG. 6 is a side elevational view, in part similar to FIG. 1, but shows a blank piston forging formed in accordance with an embodiment of the invention.
Figure 7:
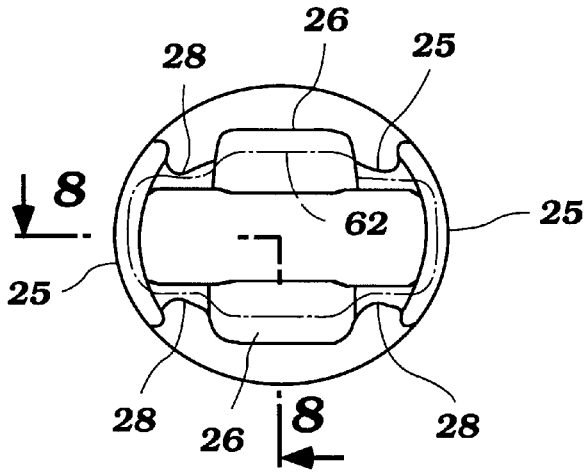
FIG. 7 is a bottom plan view, in part similar to FIG. 2, but again shows the blank formed in accordance with an embodiment of the invention.
Figure 8:
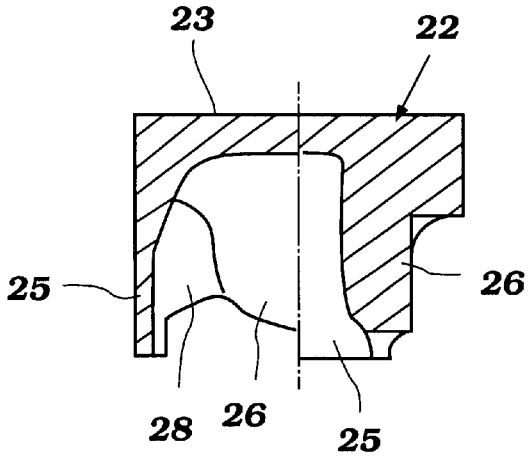
FIG. 8 is a cross-sectional view taken along the line 8—8 of FIG. 7 and is in part similar to FIG. 3, except for showing the blank formed in accordance with an embodiment of the invention.

FIGS. 6–8 show a piston blank, indicated generally by the reference numeral 51, which is formed by a forging process and with forging dies embodying the invention. Except for one feature, which will be described later, the piston blank 51 has the same components as the conventional piston and these components have the same general configuration. Therefore, where components of the piston are the same as the prior art type of construction, they have been identified by the same reference numerals and further description of them is not necessary.

It should be noted, however, that the forged piston blank 51 in the as-forged state does not have the piston pin receiving openings 27 machined in it yet nor does it have the piston ring groove 24 formed yet. These areas are machined by a suitable machining process or processes after the forging has been completed, as has already been described.

Figure 9:
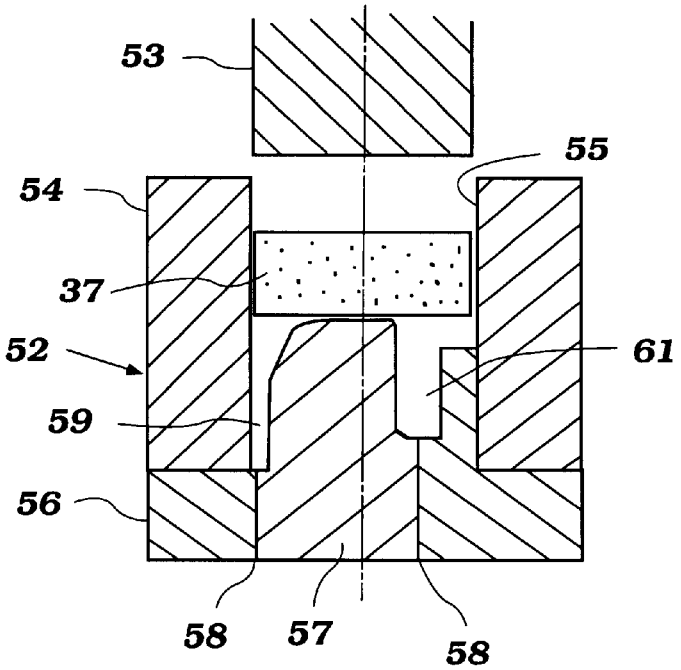
FIG. 9 is a cross-sectional view taken through a forging die formed in accordance with an embodiment of the invention and taken along a plane similar to the plane of FIG. 8 and showing the forging die with the blank in place but before the actual forging process has been initiated.
Figure 10:
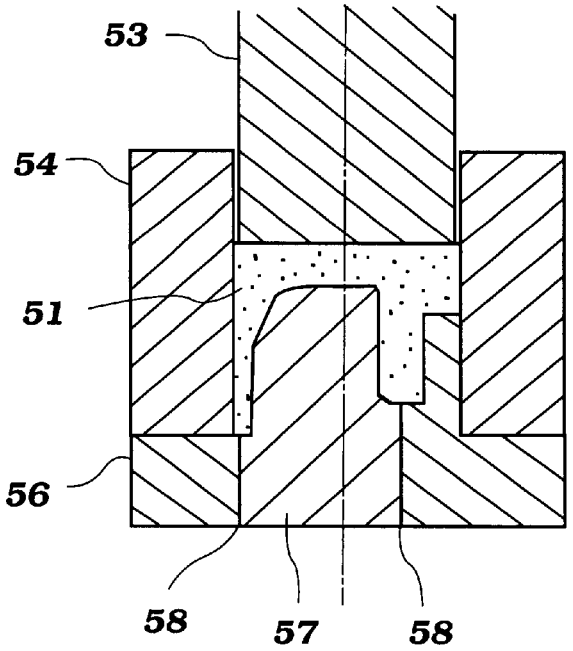
FIG. 10 is a cross-sectional view, in part similar to FIG. 9, and shows the die at the end of the forging step.

FIGS. 9 and 10 show a forging apparatus or forging die in accordance with a first embodiment of the invention. Like the prior art type of construction, the die includes a female portion, indicated generally by the reference numeral 52, and a male portion 53. The male and female portions 53 and 52 form a cavity at the completion of their stroke as seen in FIG. 10 which has a configuration that corresponds to the shape of the forged blank 51 except for shrinkage.

In this embodiment, the female die portion 52 is formed by three rather than two pieces as with the prior art type of construction. These comprise a first cylindrical piece 54 which has a bore 55 that forms in part the cylindrical portion of the cavity. In this embodiment, there is provided a pair of end pieces 56 and 57 which mate together along curved surfaces 58. The outer piece 56 and the inner piece 57 form recesses 59 and 61 which result in the formation of the piston skirt portions 25 and rib portions 28, respectively.

It should be noted that the die pieces 56 and 57 and specifically their mating surfaces 58 lie approximately at the midpoint of the lower portions of these cavity recesses 59 and 61. The mating surfaces 58 extend generally parallel to the reciprocal axis along which the relative movement of the male and female die portions 53 and 52 occur.

In connection with the forging process, the piston blank 37 is formed from a material, of a type which will be described later, and is heated to a temperature between 400° and 500° C. either before being placed in the dies or being heated within the dies. Alternatively or in combination, the dies may be heated to this temperature and if both the dies are heated and the blank is heated before insertion, the forging process may occur more rapidly.

As the blank is compressed within the dies by their relative movement and as seen in FIG. 10, compressive stresses on the blank 37 and specifically in the cavity portions 59 and 61 will place a circumferential force on the dies and particularly on the members 55 and 56 which cause them to slightly separate along the mating surface 58. This relieves the stresses and avoids cracking of the dies.

In addition, this results in the formation of a flash or parting line 62 (FIG. 7) and the lower peripheral edges of the skirt portions 25 and rib portions 28 of the piston. In addition to relieving the dies from cracking stresses, this also ensures against air entrapment and resulting porosity in these portions of the finished piston.

Figure 11:
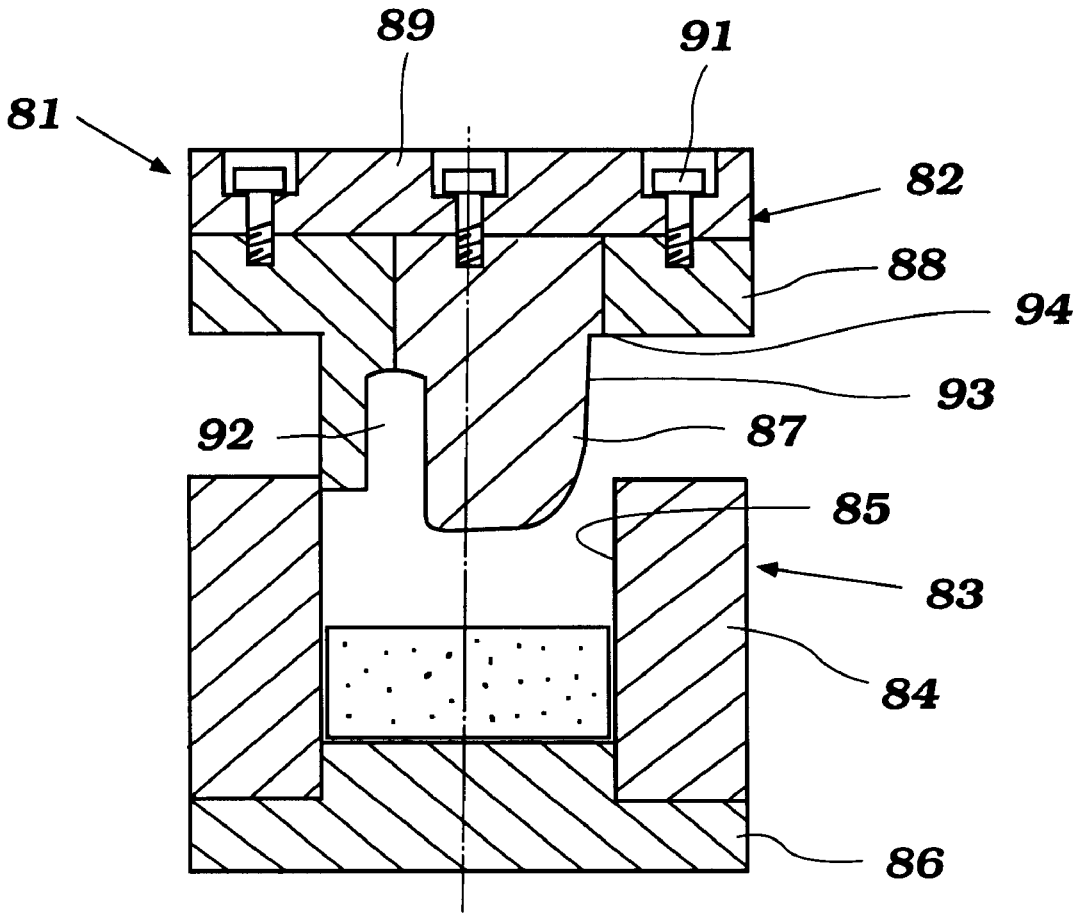
FIG. 11 is a cross-sectional view, in part similar to FIG. 9, and shows another embodiment of the invention.

In the embodiment as thus far described, the female die has formed primarily the shape of the piston with the male die forming only the head portion and serving the purpose of extruding the piston blank material into its finished shape. FIG. 11 shows an embodiment wherein the functions are somewhat reversed between the male and female dies. Nevertheless, the same concept of the invention is embodied. That is forming the skirt and rib portions by a two-piece member is applied with the parting line again in the area where the greatest amount of extrusion occurs.

The die set in accordance with this embodiment is identified generally by the reference numeral 81 and includes a male die portion 82 and a female die portion 83.

The female die portion 83 is formed by a cylindrical body portion 84 having a cylindrical bore 85 which forms the final exterior shape of the head portion and portions of the skirt. An end closure 86 is received in and closes the end of the bore 85.

The male die is comprised of a central part 87 that has a peripheral edge around which a second part 88 extends. These parts 87 and 88 are fixed to a backup plate 89 by means of threaded fasteners 91.

The portions 88 and 87 form cavities 92 which forms primarily the ribs portions 28 of the finished piston. In addition, second portions 93 act with the bore 85 to form a skirt portion 25. A parting line 94 between these portions 87 and 88 falls at the top of the two cavities so as to permit some radial movement therebetween so as to again form the flash area 62 on the underside of the pistons during the forging process.

The materials from which the blanks 37 may be formed will now be described. Although specific materials and methods of forming those materials will be described, however, it will be readily apparent to those skilled in the art that the invention is capable of use with a wide variety of other materials including materials other than aluminum and aluminum alloys.

In one specific embodiment, the piston blank may be formed from a continuous cast, bar-shaped material of an aluminum alloy. A specific alloy having the following materials in addition to Aluminum has been found to be quite useful:

Silicon (Si) 10–25% by weight
Iron (Fe) 1% by weight
Copper (Cu) 0.5–7% by weight
Magnesium (Mg) 0.1–2% by weight
Manganese (Mn) 1.5% or less by weight
Nickel (Ni) 1.5% or less by weight
Chromium (Cr) 1.5% or less by weight In accordance with another material or method of forming the blank, the continuous cast material as set forth above may be extruded from a smelting furnace through an agitator that consists of electromagnets or ultrasonic oscillators extending circumferentially around the material and before it has solidified. By utilizing this type of agitation, the materials throughout the thickness of the blank will be uniform and crystal growth is restricted. Thus, there are small sized grains that are evenly distributed throughout the blank.

Because of the fact that the material is uniform in both constituency and crystal size, the piston will have greater strength particularly because of the forging process and its yield strength increases. This also permits a high fatigue strength in the skirt portions of the piston.

Rather than forming the piston blank in a continuous casting operation, it is also possible to form the blank from powder. The powder can be formed by rapidly cooling a spray of molten material to result in a particle size with crystal grains of 10 micrometers or less and containing 10–22% by weight of silicon. A specific example of such a powdered material can have the following, constituency in addition to Aluminum:

Silicon (Si) 10–22% by weight
Iron (Fe) 1–10% by weight
Copper (Cu) 0.5–5% by weight
Magnesium (Mg) 0.5–5% by weight
Manganese (Mn) 1% or less by weight
Nickel (Ni) 1% or less by weight
Chromium (Cr) 1% or less by weight
Zirconium (Zr) 2% or less by weight
Molybdenum (Mo) 1% or less by weight)

An aluminum alloy with this constituency has greatly improved performance for a piston. The silicon adds to the resistance against wear and seizure by precipitating hard internal crystals and silicon grains in the metallic composition.

The iron increases the strength at temperatures of 200° C. and higher by strengthening the metallic composition by dispersion.

Copper and magnesium also increase the strength at temperatures of 200° C. or lower.

The average grain size of the aluminum powder is about 100 microns and the average grain size of the silicon contained in the powder is 10 micrometers or smaller. The silicon is evenly distributed through the grains of the aluminum alloy. This construction also reduces the likelihood of cracking during the forging process because the cracking of the crystal grains does not occur. This adds significantly also to the fatigue strength particularly in the skirt portion.

Another form of powder formed by the rapid cooling of the sprayed metal also can substitute silicon carbide (SiC) for silicon. This harder material further increases the wear resistance. A specific constituency of such an alloy in addition to Aluminum is as follows:

Silicon (Si) 10–22% by weight
Iron (Fe) 1–10% by weight
Copper (Cu) 0.5–5% by weight
Magnesium (Mg) 0.5–5% by weight
Manganese (Mn) 1% or less by weight
Nickel (Ni) 1% or less by weight
Chromium (Cr) 1% or less by weight
Zirconium (Zr) 2% or less by weight
Molybdenum (Mo) 1% or less by weight
Silicon Carbide (SiC) 1% by weight With this process, the silicon carbide will be dispersed with the silicon and the silicon particles are arranged at 10 micrometers or smaller. An average particle size of the silicon carbide is also in this range that is 10 micrometers or smaller. These particles are evenly dispersed within the aluminum during this process.

The specific process utilized is melting the temperature of the alloy or rather than ingot formed from the alloy at a temperature of 700° C. or higher and then spraying it in the state of a mist and rapidly cooling at a rate of 100° C. per second or faster to form the powder. Alternatively, the aluminum itself may be formed by this method and the other ingredients added as particles of the appropriate size and then compressed into the blank. This compression is done under a temperature that is less than the melting temperature of 700° C. and preferably in the range of 400–500° C. Once the blank is formed it is then cut into sections of the appropriate length.

Another way in which the powdered metal may be formed into the blanks is by rolling it through rolls while at the temperature in the range of 400–500° C.

Thus, from the foregoing description it should be readily apparent to those skilled in the art that the described method and die is very effective in forming pistons that will have a high strength and light weight and without having unnecessary or premature wear or failure of the forging die. Of course, however, the foregoing description is that of the preferred embodiment of the invention. Various changes and modifications may be made without departing from the spirit and scope of the invention, as defined by the appended claims.

What is claimed is:

1. A forging die comprised of a female portion defining an internal cavity into which a blank is inserted and extruded through cooperation of a forging die male portion that extends into said cavity and cooperates with said female die so as to extrude the blank into a desired finished shape that conforms generally to the cavity formed by said male and female die portions at the ends of their stroke, said cavity having a deep extrusion portion that defines a relatively narrow lower peripheral edge, one of said die portions being formed from two pieces that have mating surfaces that extend along the peripheral surface of this cavity and which can move relative to each other slightly under compressive forces, said mating surfaces extending from said peripheral surface of said cavity to an exterior area of each of said two pieces so as to provide stress relief and a path for air escape during the forging process.

2. A forging die as set forth in claim 1 wherein the mating surfaces of the two pieces define a closed curved shape.

3. A forging die as set forth in claim 2 wherein the mating surfaces extend parallel to the direction of relative movement of the dies upon the forging.

4. A forging die as set forth in claim 3 wherein the mating surfaces move in a direction perpendicular to the direction of relative movement of the dies in an amount sufficient to permit the formation of a closed curved flashing portion on the periphery of the finished, forged article.

5. A forging die as set forth in claim 1 wherein the article forged comprises a piston having a cylindrical head portion, a pair of circumferentially spaced skirt portions, a pair of circumferentially spaced boss portions between said skirt portions and adapted to receive the ends of a piston pin and rib portions connecting said boss portions and said skirt portions.

6. A forging die as set forth in claim 5 wherein the skirt portions are formed at least in part by the cavity deep extrusion portion.

7. A forging die as set forth in claim 6 wherein the rib portions are also formed at least in part by the cavity deep extrusion portion.

8. A forging die as set forth in claim 7 wherein the mating surfaces of the two pieces define a curved shape.

9. A forging die as set forth in claim 8 wherein the mating surfaces extend parallel to the direction of relative movement of the dies upon the forging.

10. A forging die as set forth in claim 9 wherein the mating surfaces move in a direction perpendicular to the direction of relative movement of the dies in an amount sufficient to permit the formation of a closed curved flashing portion on the periphery of the finished, forged piston.

11. A forging method utilizing a forging die comprised of a female portion defining an internal cavity and a forging die male portion that extends into said cavity and cooperates with said female die, said cavity having a deep extrusion portion that defines a relatively narrow lower peripheral edge, one of said die portions being formed from two pieces that have mating surfaces that extend along the peripheral surface of this cavity, said method comprising the steps of inserting a blank into said female die when said male die is spaced therefrom, moving said male and female dies in a direction to decrease the volume of said cavity and extruded said blank into the desired finished form, and permitting said two die pieces to move relative to each other slightly under compressive forces, the mating surfaces extending from the peripheral surface of the cavity to an exterior area of each of the two pieces so as to provide stress relief and a path for air escape during the forging process.

12. A forging method as set forth in claim 11 wherein the mating surfaces of the two pieces define a curved shape.

13. A forging method as set forth in claim 12 wherein the mating surfaces extend parallel to the direction of relative movement of the dies upon the forging.

14. A forging method as set forth in claim 13 wherein the mating surfaces move in a direction perpendicular to the direction of relative movement of the dies in an amount sufficient to permit the formation of a closed curved flashing portion on the periphery of the finished, forged article.

15. A forging die method as set forth in claim 11 wherein the article forged comprises a piston having a cylindrical head portion, a pair of circumferentially spaced skirt portions, a pair of circumferentially spaced boss portions between said skirt portions and adapted to receive the ends of a piston pin and rib portions connecting said boss portions and said skirt portions.

16. A forging die method as set forth in claim 15 wherein the skirt portions are formed at least in part by the cavity deep extrusion portion.

17. A forging method as set forth in claim 16 wherein the rib portions are also formed at least in part by the cavity deep extrusion portion.

18. A forging method as set forth in claim 17 wherein the mating surfaces of the two pieces define a curved shape.

19. A forging method as set forth in claim 18 wherein the mating surfaces extend parallel to the direction of relative movement of the dies upon the forging.

20. A forging method as set forth in claim 19 wherein the mating surfaces move in a direction perpendicular to the direction of relative movement of the in an amount sufficient to permit the formation of a closed curved flashing portion on the periphery of the finished, forged piston.

* * * * *